US008274239B2

(12) United States Patent
Felty

(10) Patent No.: US 8,274,239 B2
(45) Date of Patent: Sep. 25, 2012

(54) OPEN CIRCUIT VOLTAGE CLAMP FOR ELECTRONIC HID BALLAST

(75) Inventor: Jeffrey Glenn Felty, Elyria, OH (US)

(73) Assignee: General Electric Company, Schenectady, NY (US)

( * ) Notice: Subject to any disclaimer, the term of this patent is extended or adjusted under 35 U.S.C. 154(b) by 289 days.

(21) Appl. No.: 12/796,723

(22) Filed: Jun. 9, 2010

(65) Prior Publication Data

US 2011/0304279 A1 Dec. 15, 2011

(51) Int. Cl.
*H05B 41/16* (2006.01)

(52) U.S. Cl. ..... 315/247; 315/224; 315/209 R; 315/291; 315/307

(58) Field of Classification Search ..... 315/247, 315/224, 209 R, 274–279, 225, 291, 307
See application file for complete search history.

(56) References Cited

U.S. PATENT DOCUMENTS

| | | | |
|---|---|---|---|
| 3,792,310 | A | 2/1974 | Crawford |
| 4,097,777 | A | 6/1978 | Bacharowski |
| 4,143,304 | A | 3/1979 | Hitchcock et al. |
| 4,207,497 | A | 6/1980 | Capewell et al. |
| 4,258,288 | A | 3/1981 | Michael et al. |
| 4,323,821 | A | 4/1982 | Day |
| 4,415,837 | A | 11/1983 | Sodini |
| 4,870,327 | A | 9/1989 | Jorgensen |
| 4,932,615 | A | 6/1990 | Frazier et al. |
| 4,959,593 | A | 9/1990 | Joanino |
| 5,118,994 | A | 6/1992 | Byszewski et al. |
| 5,289,084 | A | 2/1994 | Nuckolls et al. |
| 5,339,005 | A | 8/1994 | Byszewski et al. |
| 5,498,936 | A | 3/1996 | Smith |
| 5,731,667 | A | 3/1998 | Luchetta et al. |
| 5,808,450 | A | 9/1998 | Chula et al. |
| 5,909,089 | A | 6/1999 | Deurloo |
| 5,962,981 | A | 10/1999 | Okude et al. |
| 6,049,177 | A | 4/2000 | Felper |
| 6,127,782 | A | 10/2000 | Flory, IV et al. |
| 6,194,843 | B1 | 2/2001 | Moisin |
| 6,232,727 | B1 | 5/2001 | Chee et al. |
| 6,294,880 | B1 | 9/2001 | Deurloo et al. |
| 6,429,597 | B1 | 8/2002 | Flory, IV et al. |
| 6,534,988 | B2 | 3/2003 | Flory, IV |
| 6,570,341 | B2 | 5/2003 | Padilla |
| 6,646,392 | B2 | 11/2003 | Slegers |
| 6,717,565 | B1 | 4/2004 | Kurosawa et al. |
| 6,819,063 | B2 | 11/2004 | Nemirow |
| 7,067,987 | B2 | 6/2006 | Powers, Jr. et al. |
| 7,098,606 | B2 | 8/2006 | Yu et al. |
| 7,098,607 | B2 | 8/2006 | Yu et al. |
| 7,098,608 | B2 | 8/2006 | Yu et al. |
| 7,170,235 | B2 | 1/2007 | Van Casteren |
| 7,193,368 | B2 | 3/2007 | Chen et al. |

(Continued)

OTHER PUBLICATIONS

PCT Search Report issued in connection with corresponding WO Patent Application No. US2011/036278 filed May 12, 2011.

*Primary Examiner* — Tuyet Thi Vo
(74) *Attorney, Agent, or Firm* — Fay Sharpe LLP

(57) ABSTRACT

An electronic high intensity discharge (HID) ballast (102) is presented which includes a dual mode buck converter (120) providing a DC output voltage (122) to drive an inverter (140), where the buck converter (120) regulates the DC output voltage (122) to a first value in normal operation and a clamp circuit (134) changes the converter mode to clamp the DC output open circuit voltage when the converter DC output exceeds a reference value (Vref).

20 Claims, 4 Drawing Sheets

U.S. PATENT DOCUMENTS

| | | | |
|---|---|---|---|
| 7,239,092 | B2 | 7/2007 | Mason |
| 7,282,869 | B1 | 10/2007 | Mayer et al. |
| 7,355,354 | B2 | 4/2008 | Rust et al. |
| 7,391,165 | B2 | 6/2008 | Lee et al. |
| 7,400,100 | B2 | 7/2008 | Takezawa |
| 7,521,876 | B2 | 4/2009 | Keith et al. |
| 2002/0047547 | A1 | 4/2002 | Flory, IV et al. |
| 2002/0047618 | A1 | 4/2002 | Padilla |
| 2002/0190720 | A1 | 12/2002 | Flory |
| 2006/0097665 | A1 | 5/2006 | Haruna |
| 2006/0175984 | A1 | 8/2006 | Okamoto |

OPEN CIRCUIT VOLTAGE CLAMP FOR ELECTRONIC HID BALLAST

BACKGROUND OF THE DISCLOSURE

Electronic ballasts are used to start and drive lamps, such as fluorescent lamps and high intensity discharge (HID) lamps, in artificial lighting applications. In general, the ballast converts input AC power to an intermediate DC and an output stage inverter generates an AC output to drive the lamp, and the conversion of the input AC to the intermediate DC in certain ballasts involves power factor correction. During normal operation, the ballast operates in closed-loop fashion to regulate the amplitude of the AC signals driving the lamp load. However, when the lamp load is removed from such a ballast, the inverter output voltages (open-circuit voltage) can be as high as the intermediate DC voltage level. In certain situations, such high open-circuit voltage levels may be undesirable, and there remains a need for improved HID ballast designs to provide regulated AC drive currents to HID lamps without excessive open-circuit voltages.

SUMMARY OF THE DISCLOSURE

An electronic high intensity discharge (HID) ballast is provided for driving a high intensity discharge (HID) lamp. The ballast includes a rectifier circuit that receives an AC input and provides a rectified DC voltage output. The ballast also includes a buck DC-DC converter and certain embodiments include an initial boost type DC-DC converter to receive the rectified DC voltage from the rectifier and to provide a first converter DC output voltage. The buck converter receives the first converter DC output and provides a second converter DC output voltage, and an inverter circuit with one or more switching devices converts the buck converter output to provide an AC output to a HID lamps. Certain embodiments include a boost converter circuit receiving the rectifier output and providing an intermediate DC voltage to the input of the buck converter. The boost converter in certain implementations includes a power factor correction component that controls the ballast power factor.

The buck converter includes forward and return circuit paths between the buck converter input and the buck converter output, one of which including an inductance coupled in series with a switching device driven by a buck converter switch control signal to selectively couple the buck converter input and the buck converter output, as well as a freewheeling diode coupled between the node connecting the switch and the inductance and the other circuit path. A buck control circuit in the ballast controls the converter switching device according to a mode control input signal. When the mode control input signal is at a first level, the control circuit provides the buck converter switch control signal so as to regulate the second converter DC output voltage to a first value, such as a rated voltage level of a given lamp load. When the mode control input signal is at a different second level, however, the control circuit modifies the buck converter switch control signal in order to prevent the second converter DC output voltage from exceeding a second value, where the second value is lower than the first converter DC output voltage.

The disclosed ballast further includes a clamp circuit to regulate the buck converter output by selectively providing the mode control signal to the buck converter control circuit. The clamp circuit senses the buck converter output voltage and provides the mode control signal at the first level when the sensed voltage is below a reference value. If the buck converter output voltage exceeds the threshold, however, the clamp circuit provides the mode control signal at the second level to override the normal power control loop and thereby cause the control circuit to prevent the second converter DC output voltage from exceeding the second value.

In certain embodiments, the buck converter control circuit turns the switching device off when the mode control input signal is at the second level. The buck control circuit, moreover, may include a timer and attempts to restart the buck converter switch control signal a predetermined time period after the switching device is turned off.

In certain embodiments, the buck converter control circuit includes a Critical Conduction Mode (CRM) controller and the clamp circuit provides the mode control input signal to a disable input of the CRM controller. In this case, when the mode control input signal is at the first level, the CRM controller provides the buck converter switch control signal to the switching device to regulate the second converter DC output voltage to the first value, and when the mode control input signal is at the second level, the CRM controller turns the switching device off.

Certain embodiments or the clamp circuit include a feedback circuit to provide a feedback signal representative of the second converter DC output voltage, as well as a reference circuit, a comparator, and a clamp circuit switching device. The reference circuit provides a reference voltage signal which represents a reference value at which an open circuit output voltage of the buck converter output is to be limited, and the comparator circuit compares the feedback signal to the reference voltage signal. The clamp circuit switch is coupled a comparator output and provides the mode control input signal at the first level when the feedback signal is less than the reference voltage signal and at the second level when the feedback signal is greater than the reference voltage signal.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
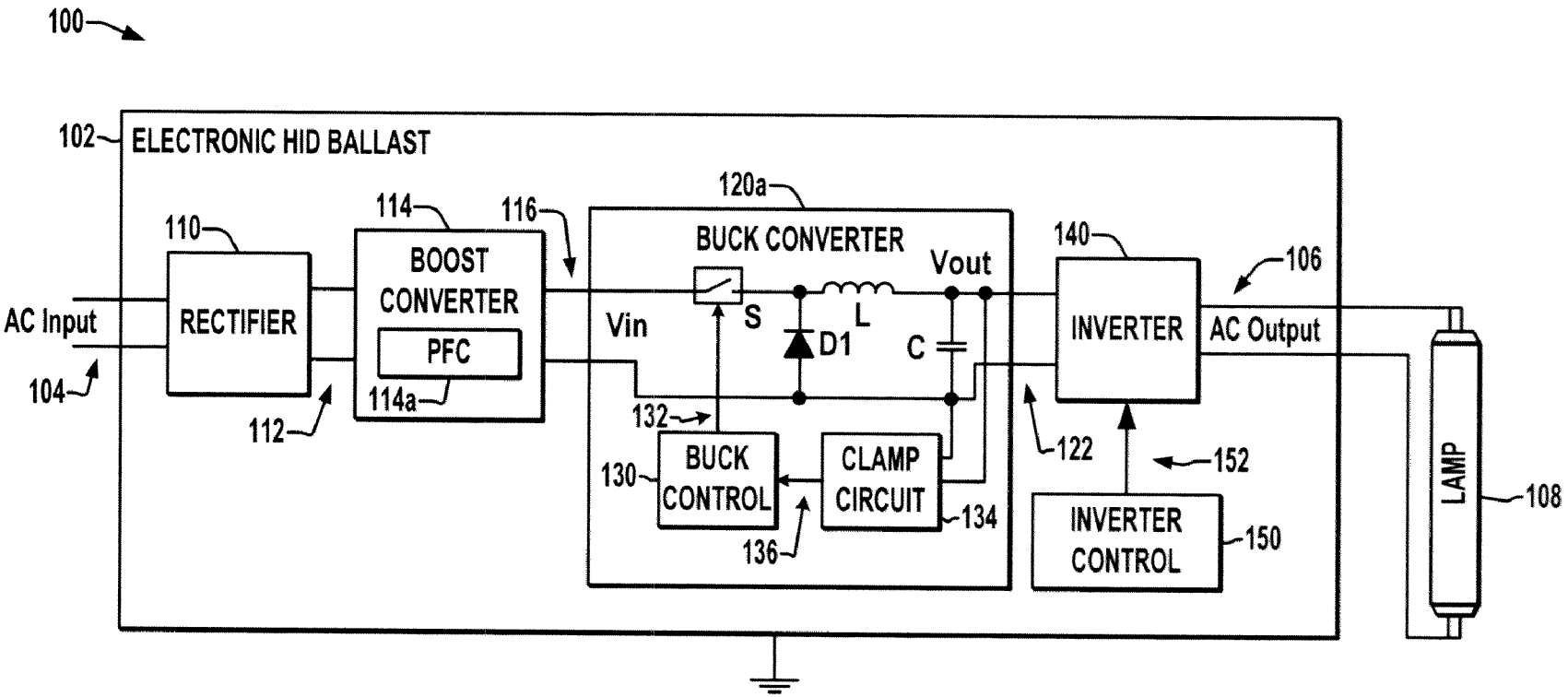
FIG. 1 is a schematic diagram illustrating an exemplary artificial lighting system with an electronic high intensity discharge (HID) ballast driving a discharge lamp load, with the ballast including a high-side buck converter circuit and a clamp circuit to limit the buck converter output in one mode of operation.

Referring now to the drawings, like reference numerals are used in the figures to refer to like elements throughout, and the various features are not necessarily drawn to scale. The present disclosure relates to HID ballasts and will be illustrated in connection with certain exemplary low frequency square wave electronic HID ballasts that can be operated by fixed or universal AC input voltages.

Figure 2:
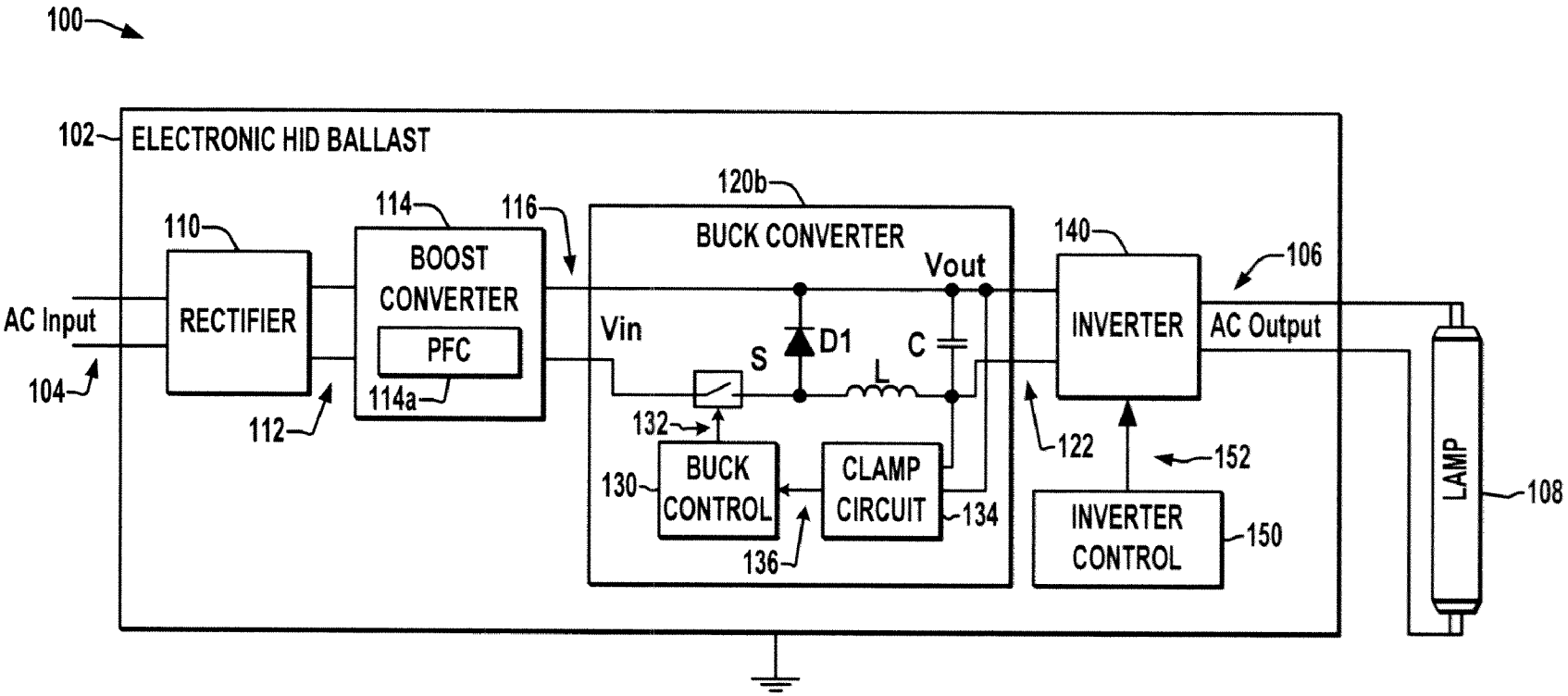
FIG. 2 is a schematic diagram illustrating another exemplary electronic HID ballast with a low-side buck converter circuit and a clamp circuit.

FIGS. 1 and 2 illustrate exemplary artificial lighting systems 100 in which an electronic HID ballast 102 receives power from an AC supply source 104 and provides an AC output 106 to drive a discharge lamp 108. The ballast 102 includes a rectifier 110 that receives and rectifies single or multi-phase AC power from a ballast input 104, where any form of active or passive, full or half-wave rectifier 110 may be employed, such as a full bridge rectifier having four diodes (not shown) in one embodiment. The rectifier 110 has an output 112 providing a rectified DC voltage to boost converter circuit 114 having a boost converter output 116 providing a first converter DC output voltage to a buck converter circuit 120. In certain embodiments, the boost converter circuit 114 has a power factor correction component 114*a* operative to control a power factor of the ballast 102. In other embodiments, the boost converter 114 may be omitted, with the rectifier 110 providing the rectified DC voltage 112 as an input to the buck converter 120. The buck converter 120 includes an input (Vin in FIGS. 1 and 2) receiving the first converter DC output voltage, as well as an output 122 (Vout in FIGS. 1 and 2) providing a second converter DC output voltage. The ballast 102 includes an inverter 140 operatively coupled to the buck converter output 122 to convert the second converter DC output voltage to provide an AC output voltage to drive a lamp 108 at an inverter output 106. The inverter 140 may be any suitable DC to AC converter, such as including switching devices operated according to inverter control signals 152 from an inverter controller 150, and which may optionally include a transformer or other isolation components (not shown) to isolate the AC output 106 from the input power.

As shown in FIGS. 1 and 2, a forward circuit path extends between the buck converter input and the buck converter output 122, and a return circuit path extends between the buck converter input and the buck converter output 122. The embodiment of FIG. 1 includes a 'high-side' buck converter 120*a* with a switching device S in an upper (forward) circuit branch, whereas FIG. 2 shows a 'low-side' buck converter 120*b* embodiment with a switch S in a lower (return) circuit branch.

As shown in FIG. 1, the high-side buck converter circuit 120*a* includes a switch S in the forward (upper) circuit path, which is selectively operated to be conductive (low impedance) or non-conductive (high impedance) so as to conduct or prevent conduction according to a buck converter switch control signal 132. The switching device S may be any suitable form of switch operable via one or more electrical control signals 132 from the controller 130 to switch between an ON or conducting state and an OFF or non-conductive state, such as MOSFETs, IGBTs, or other semiconductor-based switching components or combinations of switching components (e.g., S may comprise two or more semiconductor-based switches connected in series or parallel for operation to selectively transition between ON and OFF states according to corresponding control signals 132). Operation of the switching device S selectively couples the buck converter input and the buck converter output 122 in the forward circuit path. The forward path in this embodiment also includes an inductance L coupled in series with the switching device S, and the buck converter 120*a* also includes an output filter capacitance C coupled across the output 122, although not a strict requirement of the disclosure. In addition, the converter 120*a* includes a freewheeling diode D1 coupled between the return path and a node of the forward path that joins the switching device S and the inductance L. In operation, closure of the switch S charges the inductance L with current provided by the boost converter 114, and opening the switch causes return current from the inverter 140 to flow through the diode D1, with the selective actuation of the switching device S creating a regulated output voltage Vout that is generally less than or equal to the buck converter input voltage Vin.

Figure 3:
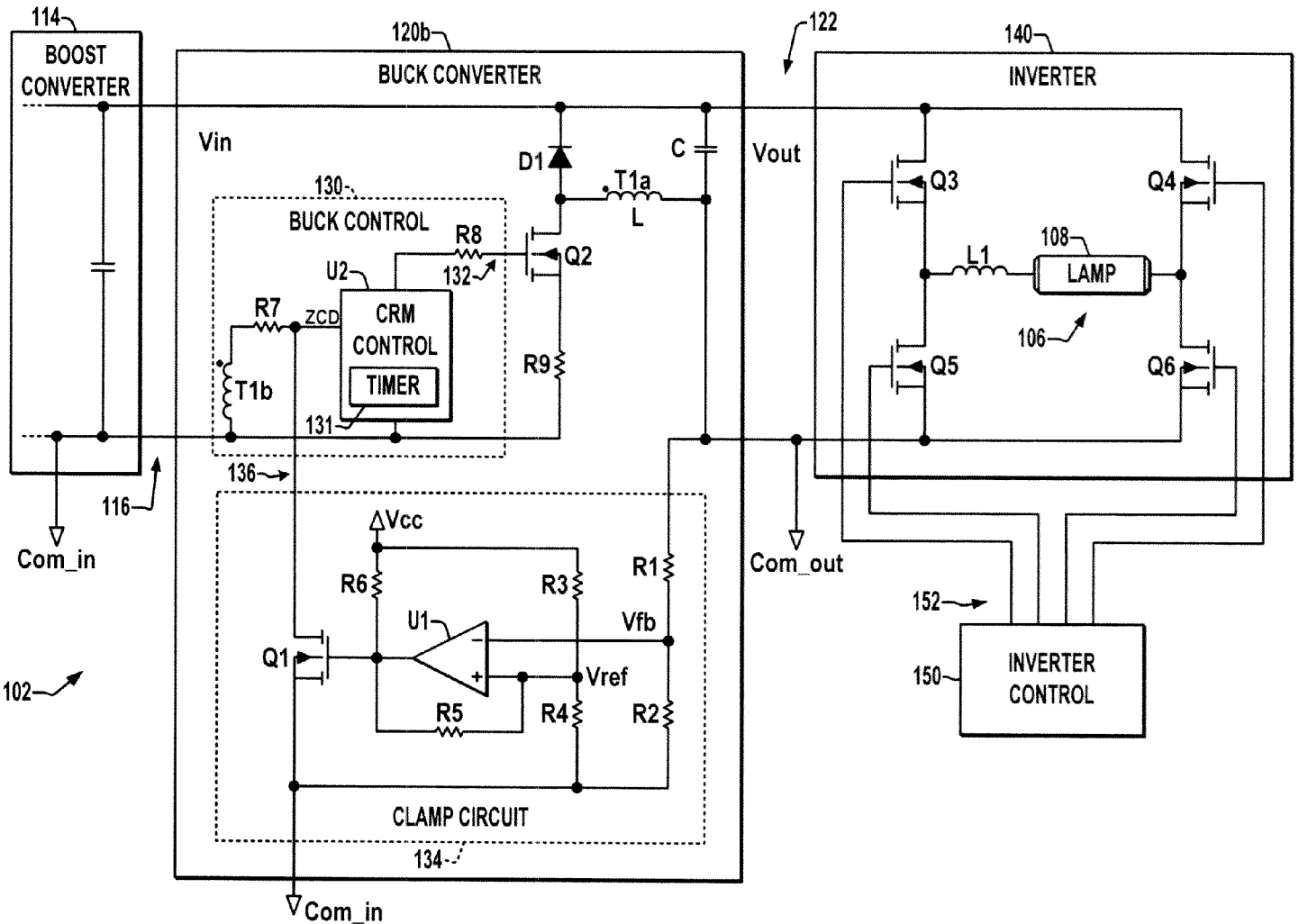
FIG. 3 is a schematic diagram illustrating further details of a low side buck converter and clamp circuit embodiment in an electronic HID ballast.

In the embodiments of FIGS. 2 and 3, the buck converter 120*b* is a low-side buck converter circuit in which the switching device S (Q2 in FIG. 3) is coupled in the return circuit path and operates according to the buck converter switch control signal 132 to selectively couple the buck converter input and the buck converter output 122 in the return circuit path. In these implementations, moreover, the inductance L (transformer winding T1*a* in FIG. 3) is coupled in series with the switching device S (Q2) in the return circuit path, and a freewheeling diode D1 is coupled between the forward circuit path and a node of the return circuit path joining the switching device S (Q2) and the inductance L (T1*a*).

The buck switching control signal 130 is provided by a buck converter control circuit 130. The buck converter controller 130 can be any suitable hardware, processor-executed software, processor-executed firmware, configurable/programmable logic, or combinations thereof by which suitable switching control signals 132 may be generated for driving the switching device S to implement a desired conversion of the input voltage Vin to generate the second converter DC output (Vout). The control circuit 130 receives a mode control input signal 136 from a clamp circuit 134 and operates when the mode control input signal 136 is at a first level to provide the buck converter switch control signal 132 to regulate the second converter DC output voltage to a first value. For example, for a certain type of HID lamp load 108 rated for nominal 90 volt operation, the buck converter nominal regulation point may be a first value of around 100 volts DC such that the subsequent AC regulation of the lamp output 106 by the inverter 140 has enough headroom to accommodate the load 108. Other first regulating point values may be used by the control circuit 130 depending on the requirements of the inverter 140 and load 108. The inverter circuit 140 receives the second converter DC output voltage from the output 122 and employs a plurality of inverter switching devices (e.g., Q3-Q6 in FIG. 3) operated according to inverter switching control signals 152 from an inverter controller 150 to convert the second converter DC output voltage to provide an AC output voltage at the inverter output 106 to drive one HID lamp 108.

When the mode control input signal 136 is at a second level, the control circuit 130 modifies the buck converter switch control signal 132 to prevent the second converter DC output voltage from exceeding a second value, where the second value is lower than the first converter DC output voltage (lower than Vin). For instance, in the case where the lamp 108 undergoes a hot restrike or the lamp 108 is removed from the system 100, the AC output voltage 106 across the lampholder terminals can be advantageously limited by controlling the buck converter output 122 to the second value that is lower than the boost converter output. In one example, a 120 volt AC input may be converted by the boost converter 114 to provide a first converter DC output voltage of about 300 volts DC. However, in cases in which a boost PFC converter 114 is used to improve both the power factor and total harmonic distortion (THD) with high efficiency, the PFC circuit 114*a* may require the first converter output voltage 116 be greater than the maximum peak input voltage, and the ballast 102 may need to have a universal input 104. For a universal input voltage range, a typical output of the boost PFC is approximately 450 Vdc. For instance, the ballast 102 may accommodate 120V, 230V, or 277V AC input levels, and the boost converter can provide Vin to the buck converter 120 at up to about 450 volts DC. In this case, it may be desired to limit the lamp output terminal voltage to 300 volts or some other value when the lamp 108 is removed. In this situation, the clamp circuit limits buck converter output to the second level (e.g., 300 VDC) such that the AC output (e.g., square wave output) from the inverter 140 remains at or below 300 volts peak-peak. Thus, the electronic HID ballast 102 can accommodate a variety of different input power levels and still ensure that the AC output 106 remains at or below a desired maximum voltage level, such as when the lamp 1008 is removed, through the dual mode control provided by the buck converter control circuit 130.

Referring in particular to FIG. 3, the clamp circuit 134 is operatively coupled with the buck converter output 122 to sense the second converter DC output voltage (Vout) and provides the mode control input signal 136 to the buck converter control circuit 130. In operation, the clamp circuit 134 provides the mode control input signal 136 at the first level when the second converter DC output voltage Vout is less than a reference value Vref, and provides the mode control input signal 136 at the second level when Vout is greater than Vref. In the embodiment of FIG. 3, the buck converter control circuit 130 is operative when the mode control input signal 136 is at the second level to turn the switching device Q2 (S) off, and also includes a timer 131 operative to attempt to restart the buck converter switch control signal 132 a predetermined time period after the switching device Q2 is turned off. In the embodiment of FIG. 3, moreover, the buck converter control circuit 130 comprises a Critical Conduction Mode CRM controller U2 having a ZCD input that receives the mode control input signal 136 from the clamp circuit 134. When the mode control input signal 136 is at the first level (high), the CRM controller U2 provides the buck converter switch control signal 132 to the switching device Q2 to regulate Vout to the first value, such as for driving a lamp load 108 under normal conditions. When the mode control input signal 136 is at the second (low) level (e.g., when the lamp 108 is removed), the controller U2 turns the switching device Q2 off, and then tries to restart the converter 120*b* after a predetermined time using the timer 131.

In this embodiment, the clamp circuit 134 includes a feedback circuit including R1 and R2 that provides a feedback signal Vfb representing the second converter DC output voltage (relative to 'Com_in' in FIG. 3), as well as a reference circuit (Vcc, R3, and R4) provides a reference voltage signal Vref representing a reference value at which an open circuit output voltage of the buck converter output 122 is to be limited. A comparator circuit including U1, R5, and R6 compares the feedback signal Vfb to the reference voltage signal Vref, and the output of U1 drives the gate of a switching device Q1 (e.g., MOSFET) so that Q1 provides the mode control input signal 136 at the first level when Vfb is less than Vref and provides the mode control input signal 136 at the second level when Vfb is greater than Vref.

In normal operation (with Q1 off), the controller U2 provides critical conduction mode operation of the buck converter switch Q2 to reduce the input voltage Vin down to the proper lamp voltage at Vout (e.g., 85-110V in one implementation) while regulating the power provided to the lamp. The inverter 140 uses Vout to generate a square wave AC output 106 to the lamp 108, with the maximum value of the square wave being equal to the DC output voltage Vout of the CRM buck converter 120*b*. The CRM controller U2 knows when the current through the diode D1 reaches zero via transformer winding T1*b* and resistor R7 to control the Zero Current Detect (ZCD) input. The clamp circuit 134 monitors the voltage difference Vin−Vout via resistors R1 and R2 and selectively clamps Vout at the desired level set by Vref by selective actuation of Q1. The comparator circuit includes U1, which can be either an op-amp, a comparator, or a discrete component version. As shown, U1 is a comparator with an open collector output, which uses R6 as a pull-up resistor. The desired set point Vref is established by the values of divider resistors R3 and R4 and the level of Vcc, and the reference signal Vref will be a square wave with a DC offset, with an amplitude based on hysteresis resistor R5 in combination with R3 and R4.

Figure 4:
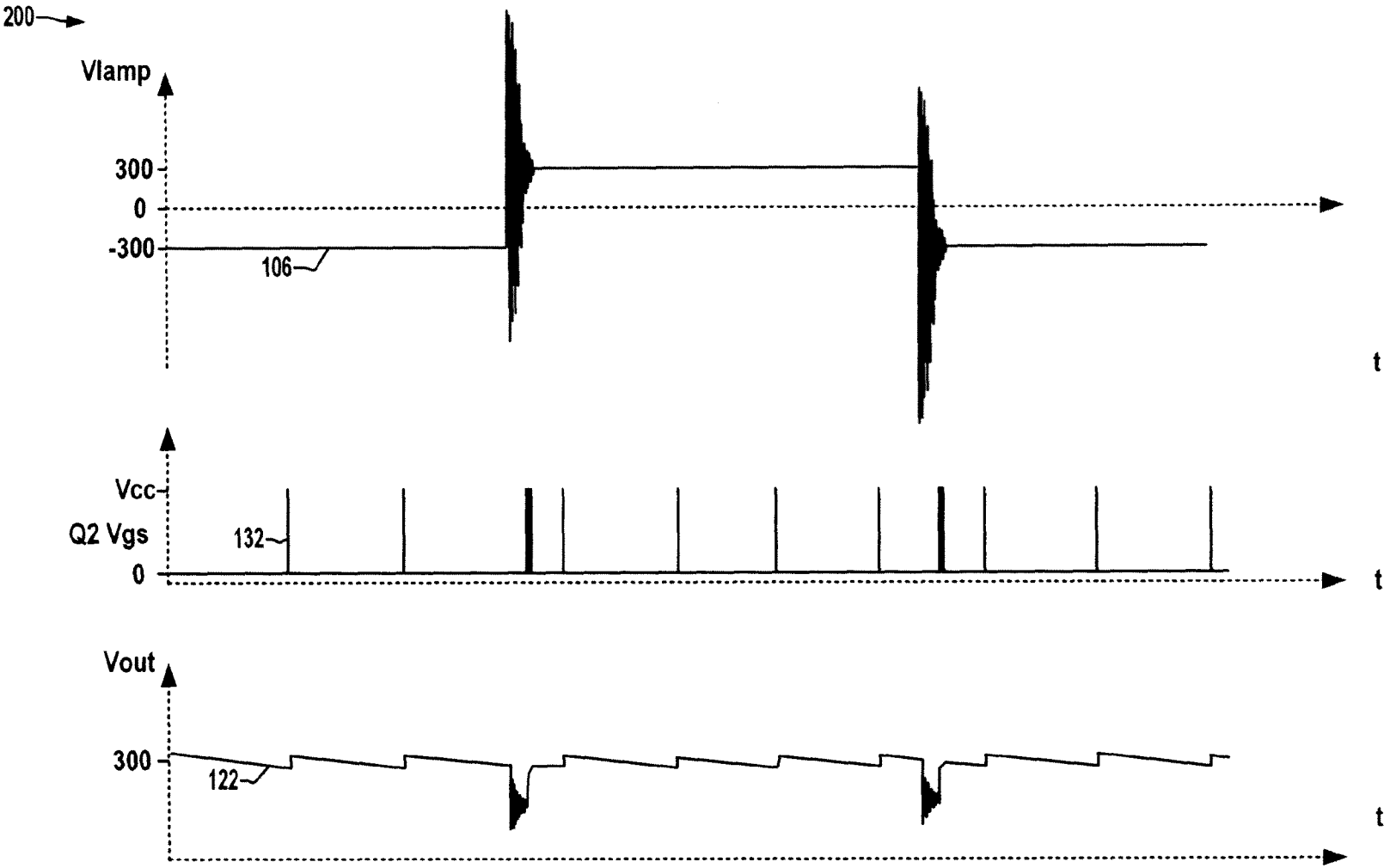
FIG. 4 is a graph illustrating exemplary lamp and inverter output voltage waveforms as well as a buck circuit switch control waveform in the ballast of FIG. 3.

Referring also to FIG. 4, exemplary operation of the buck converter 120*b*, the buck controller 130, and the clamp circuit 134 is shown in a graph 200 of FIG. 4, including curve 106 showing the output lamp voltage 106, the gate-source voltage (switch control signal Vgs) 132 of the switch Q2, and the buck converter output voltage Vout 122. When Vout is too high, the output of U1 will go high, causing transistor Q1 to turn on. This pulls the ZCD pin of the controller U2 low, and the controller U2 responds by disabling the switch Q2 (turns off the gate signal to Q2). Vout will then discharge through the load of the inverter 140. When Vout decreases to a point detected by Vfb transitioning back below Vref, the comparator output will return low to again turn Q1 off. This releases the ZCD pin of the controller U2. Once the internal timer 131 of the controller U2 times out (e.g., microsecond range), the gate signal of Q2 goes high and the buck converter 140 turns on again to attempt a restart, and the second converter output voltage Vout will now increase. This process may continue as shown in FIG. 4 for the condition with the lamp 108 removed, with the lamp output voltage thus clamped (e.g., to +/−300 v in the illustrated example) and the buck converter output voltage taking a sawtooth waveform shape with a DC bias equal to the desired Vout. The sawtooth period in this case is determined by the voltage discharge rate to the inverter load (including the capacitance value of the buck converter's output cap C in FIG. 3), any prop delays in U1 circuitry, and by the timer 131 of the buck controller U2, which is separate and independent of the inverter switching period as seen in FIG. 4. This form of clamped-output operation continues until the lamp is replaced and starts (not shown in the graph 200). The ballast 102 thus accommodates universal input levels, along with the possibility of PFC front-end operation, and also provides for clamping the output voltage without compromising circuit performance, and may thus allow usage of lower voltage parts, such as capacitors and resistors and/or a reduction in the number of components to implement the ballast 102.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Modifications and alterations will occur to others upon reading and understanding the preceding detailed description. It is intended that the invention be construed as including all such modifications and alterations.

The following is claimed:

1. An electronic high intensity discharge (HID) ballast for driving a high intensity discharge (HID) lamp, comprising:

a rectifier circuit operative to receive input AC electrical power and having a rectifier output providing a rectified DC voltage;

a boost converter circuit operative to receive the rectified DC voltage and having a boos converter output providing a first converter DC output voltage;

a buck converter including a buck converter input operative to receive the first converter DC output voltage, a buck converter output providing a second converter DC output voltage, a forward circuit path between the buck converter input and the buck converter output, and a return circuit path between the buck converter input and the buck converter output, the buck converter comprising:

a switching device coupled in a first one of the forward and return circuit paths and operable according to a buck converter switch control signal to selectively couple the buck converter input and the buck converter output in the first one of the forward and return circuit paths, an inductance coupled in series with the switching device in the first one of the forward and return circuit paths, a freewheeling diode coupled between a node of the first one of the forward and return circuit paths joining the switching device and the inductance and a second one of the forward and return circuit paths, and a buck converter control circuit receiving a mode control input signal and operative when the mode control input signal is at a first level to provide the buck converter switch control signal to the switching device to regulate the second converter DC output voltage to a first value, and operative when the mode control input signal is at a second level to modify the buck converter switch control signal to prevent the second converter DC output voltage from exceeding a second value, the second value being lower than the first converter DC output voltage;

an inverter circuit operative to receive the second converter DC output voltage and including a plurality of inverter switching devices operative according to inverter switching control signals to convert the second converter DC output voltage to provide an AC output voltage at an inverter output to drive an HID lamp; and a clamp circuit operatively coupled with the buck converter output to sense the second converter DC output voltage and operatively coupled to provide the mode control input signal to the buck converter control circuit, the clamp circuit operative to provide the mode control input signal at the first level when the second converter DC output voltage is less than a reference value, and at the second level when the second converter DC output voltage is greater than the reference value.

2. The ballast of claim 1, where the clamp circuit comprises:

a feedback circuit providing a feedback signal representative of the second converter DC output voltage;

a reference circuit providing a reference voltage signal representative of a reference value at which an open circuit output voltage of the buck converter output is to be limited;

a comparator circuit operative to compare the feedback signal to the reference voltage signal; and a switching device operatively coupled with an output of the comparator circuit, the switching device operative to provide the mode control input signal at the first level when the feedback signal is less than the reference voltage signal and to provide the mode control input signal at the second level when the feedback signal is greater than the reference voltage signal.

3. The ballast of claim 2, where the boost converter circuit comprises a power factor correction component operative to control a power factor of the ballast.

4. The ballast of claim 1, where the boost converter circuit comprises a power factor correction component operative to control a power factor of the ballast.

5. The ballast of claim 1, where the buck converter is a low-side buck converter, where the switching device is coupled in the return circuit path and operable according to the buck converter switch control signal to selectively couple the buck converter input and the buck converter output in the return circuit path, where the inductance is coupled in series with the switching device in the return circuit path, and where the freewheeling diode is coupled between a node of the return circuit path joining the switching device and the inductance and the forward circuit path.

6. The ballast of claim 1, where the buck converter control circuit comprises a Critical Conduction Mode (CRM) controller having a disable input that receives the mode control input signal from the clamp circuit, the CRM controller operative when the mode control input signal is at the first level to provide the buck converter switch control signal to the switching device to regulate the second converter DC output voltage to the first value, and operative when the mode control input signal is at the second level to turn the switching device off.

7. The ballast of claim 6, where the clamp circuit comprises:

a feedback circuit providing a feedback signal representative of the second converter DC output voltage;

a reference circuit providing a reference voltage signal representative of a reference value at which an open circuit output voltage of the buck converter output is to be limited;

a comparator circuit operative to compare the feedback signal to the reference voltage signal; and a switching device operatively coupled with an output of the comparator circuit, the switching device operative to provide the mode control input signal at the first level when the feedback signal is less than the reference voltage signal and to provide the mode control input signal at the second level when the feedback signal is greater than the reference voltage signal.

8. The ballast of claim 7, where the boost converter circuit comprises a power factor correction component operative to control a power factor of the ballast.

9. The ballast of claim 6, where the boost converter circuit comprises a power factor correction component operative to control a power factor of the ballast.

10. The ballast of claim 1, where the buck converter control circuit is operative when the mode control input signal is at the second level to turn the switching device off.

11. The ballast of claim 10, where the buck converter control circuit comprises a timer operative to attempt to restart the buck converter switch control signal a predetermined time period after the switching device is turned off.

12. The ballast of claim 11, where the buck converter control circuit comprises a Critical Conduction Mode (CRM) controller having a disable input that receives the mode control input signal from the clamp circuit, the CRM controller operative when the mode control input signal is at the first level to provide the buck converter switch control signal to the switching device to regulate the second converter DC output voltage to the first value, and operative when the mode control input signal is at the second level to turn the switching device off.

13. The ballast of claim 12, where the clamp circuit comprises:

a feedback circuit providing a feedback signal representative of the second converter DC output voltage;

a reference circuit providing a reference voltage signal representative of a reference value at which an open circuit output voltage of the buck converter output is to be limited;

a comparator circuit operative to compare the feedback signal to the reference voltage signal; and a switching device operatively coupled with an output of the comparator circuit, the switching device operative to provide the mode control input signal at the first level when the feedback signal is less than the reference voltage signal and to provide the mode control input signal at the second level when the feedback signal is greater than the reference voltage signal.

14. The ballast of claim 13, where the boost converter circuit comprises a power factor correction component operative to control a power factor of the ballast.

15. The ballast of claim 11, where the clamp circuit comprises:

a feedback circuit providing a feedback signal representative of the second converter DC output voltage;

a reference circuit providing a reference voltage signal representative of a reference value at which an open circuit output voltage of the buck converter output is to be limited;

a comparator circuit operative to compare the feedback signal to the reference voltage signal; and a switching device operatively coupled with an output of the comparator circuit, the switching device operative to provide the mode control input signal at the first level when the feedback signal is less than the reference voltage signal and to provide the mode control input signal at the second level when the feedback signal is greater than the reference voltage signal.

16. The ballast of claim 11, where the boost converter circuit comprises a power factor correction component operative to control a power factor of the ballast.

17. The ballast of claim 10, where the clamp circuit comprises:

a feedback circuit providing a feedback signal representative of the second converter DC output voltage;

a reference circuit providing a reference voltage signal representative of a reference value at which an open circuit output voltage of the buck converter output is to be limited;

a comparator circuit operative to compare the feedback signal to the reference voltage signal; and a switching device operatively coupled with an output of the comparator circuit, the switching device operative to provide the mode control input signal at the first level when the feedback signal is less than the reference voltage signal and to provide the mode control input signal at the second level when the feedback signal is greater than the reference voltage signal.

18. The ballast of claim 10, where the boost converter circuit comprises a power factor correction component operative to control a power factor of the ballast.

19. An electronic high intensity discharge (HID) ballast for driving a high intensity discharge (HID) lamp, comprising:

a buck converter including a buck converter input operative to receive a DC input voltage, a buck converter output providing a converter DC output voltage, a forward circuit path between the buck converter input and the buck converter output, and a return circuit path between the buck converter input and the buck converter output, the buck converter further comprising:

a switching device coupled in a first one of the forward and return circuit paths and operable according to a buck converter switch control signal to selectively couple the buck converter input and the buck converter output in the first one of the forward and return circuit paths, an inductance coupled in series with the switching device in the first one of the forward and return circuit paths, a freewheeling diode coupled between a node of the first one of the forward and return circuit paths joining the switching device and the inductance and a second one of the forward and return circuit paths, and a buck converter control circuit receiving a mode control input signal and operative when the mode control input signal is at a first level to provide the buck converter switch control signal to the switching device to regulate the converter DC output voltage to a first value, and operative when the mode control input signal is at a second level to modify the buck converter switch control signal to prevent the converter DC output voltage from exceeding a second value, the second value being lower than the DC input voltage;

an inverter circuit operative to receive the converter DC output voltage and including a plurality of inverter switching devices operative according to inverter switching control signals to convert the converter DC output voltage to provide an AC output voltage at an inverter output to drive an HID lamp; and a clamp circuit operatively coupled with the buck converter output to sense the converter DC output voltage and operatively coupled to provide the mode control input signal to the buck converter control circuit, the clamp circuit operative to provide the mode control input signal at the first level when the converter DC output voltage is less than a reference value, and at the second level when the converter DC output voltage is greater than the reference value.

20. The ballast of claim 19, where the clamp circuit comprises:

a feedback circuit providing a feedback signal representative of the converter DC output voltage;

a reference circuit providing a reference voltage signal representative of a reference value at which an open circuit output voltage of the buck converter output is to be limited;

a comparator circuit operative to compare the feedback signal to the reference voltage signal; and a switching device operatively coupled with an output of the comparator circuit, the switching device operative to provide the mode control input signal at the first level when the feedback signal is less than the reference voltage signal and to provide the mode control input signal at the second level when the feedback signal is greater than the reference voltage signal.

* * * * *